United States Patent [19]

Desverchére

[11] 4,091,161

[45] May 23, 1978

[54] NON-WOVEN WEBS AND METHOD FOR THE DRY PRODUCTION THEREOF

[75] Inventor: Jean Desverchére, Lyons, France

[73] Assignee: Cefilac, Paris, France

[21] Appl. No.: 653,665

[22] Filed: Jan. 30, 1976

[30] Foreign Application Priority Data

Mar. 11, 1975 France ..... 75 08312

[51] Int. Cl.[2] ..... D04H 1/58

[52] U.S. Cl. ..... 428/288; 19/304; 156/62.2; 156/283; 264/121; 428/372; 428/402; 428/426; 428/443

[58] Field of Search ..... 19/155, 156, 156.1, 19/156.3, 156.4; 156/62.2, 283, 285, 286; 264/109, 120, 121, 122, 123, 112, 113; 428/288, 290, 327, 339, 372, 426, 402, 443

[56] References Cited

U.S. PATENT DOCUMENTS

| | | | |
|---|---|---|---|
| 3,328,383 | 6/1967 | Roscher et al. | 123/148 |
| 3,413,688 | 12/1968 | Sangesand et al. | 19/156.1 |
| 3,611,508 | 10/1971 | Reinhall et al. | 19/156.3 |
| 3,905,855 | 9/1975 | Blewett et al. | 428/247 |

*Primary Examiner*—James J. Bell

*Attorney, Agent, or Firm*—Dennison, Dennison, Meserole & Pollack

[57] ABSTRACT

A nonwoven uniform web is formed from particulate material and a binding agent in a moving conveyor belt. The material is fed to the belt through a cowl in a random fashion and air is removed from the material; the layer of material is subsequently thinned by a peak removal device and is precalendered, rolled and then heated to activate the binding agent. The resulting web has similar mechanical properties in length direction and width direction, and has a high elastic recovery.

9 Claims, 2 Drawing Figures

NON-WOVEN WEBS AND METHOD FOR THE DRY PRODUCTION THEREOF

Figure 1:
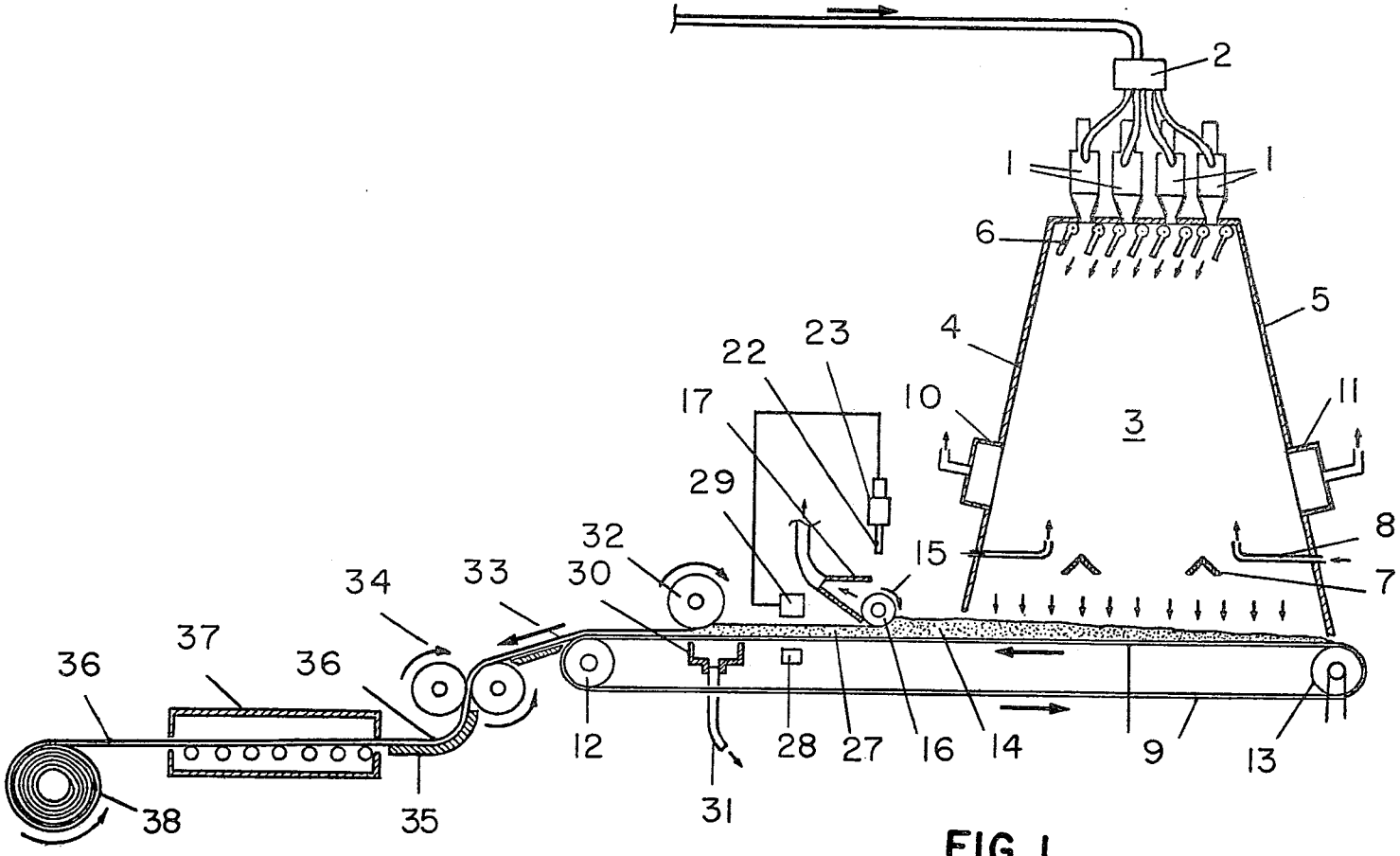

The present invention relates to a process for the manufacture of uniform webs from particulate materials, hereinafter termed "particles," a device for the implementation of this process, and to the webs obtained by this process.

The process according to the invention applies particularly advantageously to the manufacture of webs consisting of at least two different particulate constituents, of which at least one is preferably fibrous, but the process may also be applied to webs made solely from granules or powder.

There already exist numerous processes for the preparation by a wet method of webs of fibrous materials, e.g. cardboards, felts and non-woven textiles, containing a binding agent, for example an elastomer. These wet method processes involve making suspensions of fibres, optionally dissolving certain other constituents, then making a mixture of the constituents in a liquid phase, depositing it on a fixed or mobile support, generally a permeable conveyor belt, and then removing the liquid phase by progressive drying. Such processes which generally use the technique of cardboard manufacture have a number of disadvantages. In particular, they require heavy installation to provide for the removal of the liquid phase. In addition, it is not possible to use certain particulate constituents which do not readily dissolve or enter suspension. Finally, it is generally necessary to add to the aqueous suspension various agents, in particular surface active agents which manifest themselves subsequently in the dry material and affect its qualities. Furthermore, using these processes, it is difficult to obtain webs with a very constant and precise mass per surface unit, i.e. with a very homogeneous distribution of material along their surfaces. Finally the feeding of the materials in a liquid flow normally gives rise to an orientation of the fibres in a preferential direction, which adversely affects the isotropism of the finished product. Thus the majority of the fibres are generally oriented in the direction of unwinding of the belt. Its tensile strengths are generally different in the direction of the length of the belt and in the transverse direction.

The production of fibre and binding agent webs by dry-projecting jets of fibres and binding agents or mixtures thereof onto an appropriate surface has already been proposed. This dry technique requires much less heavy installations than the wet method processes but it is difficult to keep the conditions of projection constant and in practice uncontrollable eddies prevent the production of webs having a sufficiently precise mass per surface unit.

However, more and more homogeneous webs, i.e. having a more and more precise proportion of empty space and mass per surface unit, are necessary today for the production for example of seals. The present invention therefore proposes to furnish a process and a device permitting the manufacture from materials in the form of particles, of uniform non-woven webs having a good isotropism, and to do this in an economic manner while avoiding the disadvantages of the prior art. These webs are produced from particulate materials which have previously been dosed and mixed homogeneously, and which are fed continuously at a regular rate onto a conveyor belt, and are then generally compressed by calandering and optionally agglomerated by a finishing treatment. This process is characterised in that the feeding of the particles does not take place at a set point in the path of the belt but that the particles are fed and distributed simultaneously over a wide length of the belt, at a superficial volume rate of less than 2,000 $cm^3/m^2/min$ and preferably at a superficial volume rate of between 1,000 $cm^3/m^2/min$ and 100 $cm^3/m^2/min$. This feeding takes place in a current of air moving overall with a low speed, but including strong local turbulence which imparts to the particles a vertical component speed substantially lower than the free fall speed. The materials are thus arranged at random in the form of an aerated layer, which is homogeneous and isotropic and of low apparent density, having a percentage of empty space greater than 95% and preferably between 98% and 99.5%. This aerated web of materials is then pre-densified, then optionally calandered and agglomerated by a finishing treatment which may be a physical or a chemical treatment. The volume feed rate of the particles in question is the real throughput of the particles corresponding to their maximum real density without taking into account any interstitial volume. The volume of particles deposited per unit of surface is likely to vary in one and the same installation within the limits indicated, as a function of the speed of the belt and the quantity of material desired per unit of surface in the finished product. This quantity of material per unit of surface is generally defined by its mass per surface unit of (grammage).

One advantage of the present invention is that the webs thus obtained are formed from particles arranged in a particularly isotropic manner while their mass per surface unit can be precisely regulated.

The speed of displacement of the belt is generally less than 50 m/min. Unless special precautions are taken, greater speeds may give rise to accidental currents of air which might interfere with the proper distribution and orientation of the particles.

To spread as much as possible the deposition of particles over the whole length of the feed zone, it is desirable to provide return systems for the gas flow up stream and down stream of the feed zone in relation to the movement of the belt. These gas flow return systems also contribute to carrying along and eliminating the finest particles.

In order to avoid any external interference, the particles are fed through a discharge unit onto the belt which is arranged in a substantially air-tight enclosure in the form of a cowl arranged above the conveyor belt and protecting the whole particulate material feed zone of the belt. The feed unit includes means for supplying the particles at a substantially zero speed into the said enclosure.

According to an advantageous characteristic of the device according to the invention, the enclosure in the form of a cowl may be provided with substantially vertical side walls, their inclination relative to the horizontal being greater than 80° and front walls inclined in such a way that the enclosure expands towards the bottom, the inclination of the said front walls being determined as a function of the characteristics of fall of the particles, and normally being between 60° and 90° relative to the horizontal.

In its lower part, the length of the cowl defines the surface on which the conveyor belt particle supply is distributed; this surface corresponds to a superficial deposit lower than 2,000 $cm^3/m^2/min$ as required by the process according to the invention and preferably corresponding to a deposit of between 100 $cm^3/m^2/min$ and 1,000 $cm^3/m^2/min$. To ensure that the particles are deposited at random without being oriented in any preferential direction, means such as baffles and air injection nozzles are included in the cowl to ensure local zones of high turbulence inside the cowl.

In order to facilitate distribution over the whole length of the cowl, the return systems for the gas flow may advantageously be arranged up stream and down stream of the cowl in relation to the direction of movement of the conveyor belt. In addition, this gas flow return system carries away the finer particles and thus improves the homogeneity of the dimensions of the particles deposited.

In the event of the cowl having a large area, it is desirably divided into compartments by intermediate vertical partitions, extending between the two side walls.

The height of the enclosure or cowl is selected as a function of the characteristics of fall of the particles in such a way that the particles arrive on the conveyor belt with a uniform speed and direction of fall. In practice the height of fall, i.e. the height of the cowl for fibrous particles, such as mineral fibres of asbestos, glass, ceramic, vegetable fibres such as flax and cotton, animal fibres such as wool and silk, organic fibres which may be thermoplastic, thermo hardenable, polyamide, acrylic, polyesters or thermo stable fibres, is between 1 and 10 m and preferably between 4 and 6 m.

In the event of the particles being brought to the discharge unit by being transported by a current of air, the discharge unit can advantageously comprise one or more cyclone separators, which are regulated in such a way that the particles are separated from the air in which they are carried and fall out of the lower opening of the cyclone separator at an initial speed which is substantially zero.

The discharge unit should preferably include several cyclone separators regularly spaced above the conveyor belt.

In a particular embodiment, each discharge unit, such as the lower opening of a cyclone is arranged between two parallel louvres articulated on horizontal axes at right-angles to the direction of the conveyor belt, means being provided to adjust the position of the louvres and constantly modify the initial angle of fall alternately.

According to a refinement of the invention, the apparatus is also characterised by a device for removing peaks from the web, arranged down stream from the cowl.

In a preferred embodiment, this mechanism comprises a device which is rotatable about a horizontal axis arranged above the web, this rotatable device having preferably the form of a comb or rake, the teeth of which are perpendicular to the axis of rotation and are separated from one another by a distance selected as a function of the dimensions of the particles constituting the web. The peak removal device is driven so as to rotate rapidly removing the peaks from the web by means of its teeth, and means of deflection adapted to cooperate with said device are provided in order to eliminate the material removed.

Air blowing means can advantageously be present, to work in conjunction with the deflection means and to ensure the removal of the particles eliminated. In addition air blowing means can advantageously be provided so as to ensure the cleaning of the peak removal device so that the peak removal can take place continuously in normal and uniform conditions.

In this embodiment the particles coming from the peak removal can advantageously be carried away by a current of air and recycled into the apparatus.

In a particularly refined embodiment, the position of the peak removal device above the conveyor belt can be controlled by means for the control of the mass per surface unit of the web after peak removal, so as to modify the peak removal height as a function of the mass per surface unit. The peak removal can determine any profile. The axis of the peak removal device can advantageously be fixed on a trolley which is capable of sliding vertically and the vertical position of which is controlled by a suitable motor, controlled itself by the means for the control of the mass per surface unit.

The thickness of the web after peak removal is generally from 30 to 120 times and preferably from 40 to 80 times the desired thickness of the finished web, depending on the material used and the percentage of empty space desired in the finished product, (or if preferred its apparent density). After peak removal, the aerated and isotropic web still has the same percentage of empty space, greater than 95%.

In a particular interesting embodiment, the axis of the peak removal device may be inclined towards the horizontal in a plane at right-angles to the axis of advancement of the belt. In this way an aerated web is obtained of transversely variable thickness in relation to the axis of the web and which permits the production of a finished product composed of a non-woven web of agglomerated particles having a mass per unit of surface which is continuously variable transversely to the axis of the web.

In an advantageous variant of the process, a permeable conveyor belt is used, and down stream from the peak removal unit there is arranged below the belt a suction box. This box exerts a reduction in pressure within the web, sucks away the air occluded between the particles and the aerated web and even generates a gaseous current crossing successively from top to bottom the web of particles, then the conveyor belt. This device applies the particles against the belt and predensifies the particle web very homogeneously.

Above the down stream part of the suction box, the web of particles is advantageously subjected to precalendering. This pre-calendering is effected by a rolling cylinder arranged above the web. This cylinder, working in conjunction with the conveyor belt, provides a precompression of the web in such a way that, after pre-calendering, the thickness of the web, which, after peak removal had a thickness of the order of from 30 to 120 times the thickness of the finished web, is not substantially more than double that of the finished web. The proportion of empty space is then of the order of 75 to 80%.

In order to avoid deformations and irregularities on the two lateral faces of the aerated web before precalendering, the horizontal conveyor belt may advantageously be supplemented by two small lateral belts, constituting lateral edges, moving at the same speed as the horizontal conveyor belt, and by virtue of their working together, constituting in some way a U-section conveyor belt.

Down stream from the conveyor belt, the device according to the invention may optionally comprise means for the treatment and finishing of the web such as a calendering roller and a treatment unit, which may operate by heat or chemical means, and finally means for winding the agglomerated product.

The invention also relates to the webs produced by the process and in particular to webs produced from at least two intimately mixed particulate constituents.

The constituents of these webs may be fibrous, such as mineral fibres of asbestos, glass, and ceramics, vegetable fibres such as flax and cotton, animal fibres such as wool and silk, organic fibres which may be thermoplastic (polyamide, acrylic . . . ), thermo hardenable (polyimide, polyesters . . . ) or thermo stable. The particulate constituents may also include particles in granular or powder form, such as particles of resins, in particular thermo-hardenable resins, of vulcanised and unvulcanised elastomers, of particles of binding agents: these binding agents may be thermo-hardeneable (for example phenolic resins, modified phenolic resins, epoxy resins, polyester resins), thermoplastic (for example on a base of polyethylene, polystyrene, polypropylene), thermostable (for example polyimides) or they may be crude powder elastomers.

The webs according to the invention are characterised by a particularly precise and constant mass per surface unit and by an excellent homogeneity. These webs also have mechanical characteristics, in particular tensile strength, which are very similar in the longitudinal and transverse direction of the web. Because these webs are formed from particles having no preferential orientation they also have characteristics of elastic recovery which are substantially double the characteristics of webs obtained by conventional processes.

The invention relates in particular to webs of materials intended for the manufacture of seals, for example cylinder head gaskets, materials constituted of fibres such as asbestos, and of binding agents, such as thermohardenable resins or elastomers. Such webs based on "very open" asbestos and phenolic resins, have an elastic recovery defined according to ASTMD Standard 1170 62 T, of between 40 and 60% (F 36 standard).

Further advantages and characteristics of the invention will be evident from the following illustrative description, and with reference to the accompanying drawings.

Figure 2:
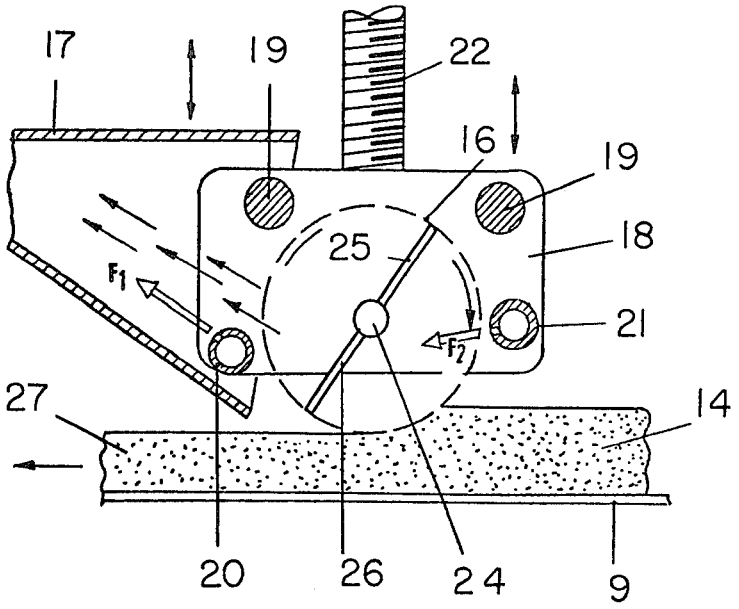

FIG. 1 shows in section a schematic elevation of a device according to the invention; and FIG. 2 shows a detailed schematic view of the device for removing peaks from the web.

The device shown is used for the manufacture of webs which are used in particular for the manufacture of cylinder head gaskets.

The raw material feeding the device is a carefully dosed and homogenised mixture of asbestos fibres which have undergone a particularly extensive grinding treatment (very open asbestos) and of thermohardenable resins such as formophenolic resins in the state of particles of very low granulometry.

This mixture is conveyed by pneumatic means to four cyclones 1. The rates of throughput of air and particles are carefully regulated as a function of the desired production of particulate webs for the manufacture of seals and as a function of the mass per surface unit desired for the web. The particles carried along by the air are carefully distributed between the four cyclones 1 by a distributor 2. The cyclones 1 separate the air from the particles of asbestos and resin. The air escapes to the atmosphere by the upper chimneys of the cyclones. The particles and a very small quantity of air escape through the lower part of the cyclones 1 at an initial vertical speed near to zero.

The four cyclones 1 are arranged at the top of a cowl 3 having a height of 4.50 m and being provided with two vertical lateral walls (not shown) and two oblique front walls 4 and 5 inclined at an angle of approximately 70° in relation to the horizontal.

At various points around the outlet of each cyclone there are located a plurality of louvres 6 pivotable about horizontal axes parallel to the front walls 4, 5, the said louvres being constantly parallel to one another and being adapted to pivot by means of motor devices which are not shown, so as alternately to be oriented towards the wall 4, as shown on the figure and then towards the opposite wall 5.

Inside the cowl 3, the particles fall in free fall at a speed which at first increases, then becomes constant, sweeping across the whole of the lower area of the cowl, under the action of the louvres 6. A considerable turbulence inside the cowl is created by means of a number of baffles 7 arranged inside the cowl 3, and a number of air injection nozzles 8 arranged in the lower part of the cowl. This local turbulence reduces the vertical component of speed of the particles in their fall and improves the homogeneity of their distribution along a conveyor belt 9. Air intake boxes 10, 11 arranged on the walls 4, 5 of the cowl suck in the air coming from the cyclones 1 or the injection nozzles. By sucking in the air up stream and down stream of the cowl, these boxes contribute to the distribution of the gas flow and consequently of the falling of the particles over the whole length of the cowl. They also assist in carrying along and eliminating the finest particles, thus restricting the range of granulometry of the particles fed.

The continuous conveyor belt 9 is a permeable belt. It is driven in the direction of the arrow by rollers 12, 13 at a rigorously constant speed. Thus there is formed on the conveyor belt 9 a very aerated web 14 having a fluffy appearance of substantially constant thickness and comprising more than 99% empty space. The web is carried along by the conveyor belt.

In the example described, the length of the cowl at its base is 6 m, while the width of the cowl and of the belt is 500 mm, the speed of the conveyor belt being 12 m/min. In these conditions, the thickness of the web 14, which is in the form of a fluffy snow-like substance is approximately 60 mm.

Downstream from the cowl, the web 14 encounters a peak removal apparatus 15 with a rotatable peak removing device 16 and means of deflection 17 which are shown in greater detail on FIG. 2.

This peak removal apparatus, 15 comprises a trolley, consisting of two vertical brackets 18 interconnected by cross-pieces 19, 20, and 21, the vertical position of this trolley being determined by the rotation of a screw 22 passing through a nut which is an integral part of one of the trolley brackets and which is driven by a direct current electric motor 23 capable of being driven in different directions of rotation, i.e. so as either to raise or lower the trolley.

The trolley is thus capable of moving vertically under the action of the motor 23 in front of the means of deflection 17 whih consists of an upper horizontal wall, a lower inclined wall and two lateral walls. It supports the rotatable peak removing device 16 which is composed of an axis 24 which is made to rotate in the direction of the arrows of the drawing by a motor unit (not shown) which is an integral part of the trolley. The rotatable axis 24 has two diametrically opposed sets of teeth 25, 26, which gives the device the motion of a double comb, of which the teeth 25, 26 are spaced at a distance of the order of a few millimeters. The teeth can advantageously be formed wth steel strip.

The cross-piece 20 is constituted by a hollow tube possessing on one of its generatrices a plurality of nozzles which enable parallel jets of compressed air to be expelled in the direction of the arrow (see FIG. 2). By sending these jets of compressed air and by the depression which results from it at the back of the tube 20 the material removed from the layer 14 by the teeth 25, 26 of the rotatable comb 16 is expelled in the direction of the arrows of the drawing inside the means of deflection 17. From there the material is sucked away and sent into a recycling circuit.

The cross-piece 21 is also constituted by a hollow tube having nozzles which expel jets of compressed air in the direction of the arrow (see FIG. 2) oriented in such a way as to remove from the teeth 25, 26 any particles which might still adhere to them, so that the teeth 25, having been completely cleaned of particles, can be assured of their peak removal action on the layer, 14.

Having passed the peak removal apparatus 15, the levelled layer 27 has a thickness which is a function of the vertical position of the device 16.

The layer 27 after the peak removal apparatus 15 passes over a beta ray emitter 28 which, by means of a suitable beta ray receiver 29 permits the exact measurement of the mass of particles per unit of surface in the levelled layer 27. As a function of the mass measured, an electric signal is transmitted through a control device (not shown) to control the motor 23 and, if necessary, to regulate the height position of the trolley on which the peak removal device 16 is mounted, so as to compensate by a variation of height of this device, for the differences between the mass measured by the devices 28 and 29 and a predetermined nominal mass, so that the levelled layer 27 has a constant mass per unit of surface over its whole length, with a deviation of less than ± 2%.

By inclining the axis 24 of the comb to the horizontal, in a transverse plane of the web, it is quite possible to obtain a web 27 of which the mass per unit surface is continuously variable transverse to the axis of the said web. In this way after rolling, a finished product can be obtained, the mass of which per unit of surface continuously varies transversely to the axis of the web without any discontinuity.

Having passed measuring devices 28, 29, the levelled layer 27 reaches a predensification point comprising a box 30 arranged under the permeable conveyor belt 9 and connected by a pipe 31 to a suction device (not shown on the drawing). By means of this suction box 30, the air occluded in the aerated web 27 is sucked away, together with any ambient air which has crossed the web of particles. This ensures a very homogeneous first settlement on the belt 9, without in any way cutting the fibres, and with the minimum of disturbance of the orientation of the particles previously deposited at random on the belt 9.

Above the down stream part of this suction box 30 there is arranged a pre-rolling 32 cylinder, rotating in the direction of the arrow, and this cylinder works together with the conveyor belt 9 to provide a first compression of the deaerated but still loose web 27, while the suction box 30 continues to attract the fibres towards the belt 9.

By way of example, the layer 14 leaving the cowl, has a thickness of approximately 60 mm. After passing under the peak removal apparatus 15, the thickness of the levelled layer 27 is reduced to 50 mm. This thickness is itself reduced to approximately 2 mm by the pre-rolling cylinder 32.

The pre-calendered web 33 is then fed to a roller 34 of known type, which reduces its thickness to 1 mm, then to a deflector 35, and the rolled web 36 is fed to a heating device 37 which activates the thermohardenable resin, and determines the final constitution of the material which is then wound on a winding device 38. Finally a compact web of a material is obtained, which can be used for the manufacture of seals having a mass per unit of surface of 750 g/m$^2$, this mass per unit of surface (grammage) varying by less than ± 2%.

The mechanical characteristics of this web, measured in the direction of the length of the web or in the direction of its width are very close. In particular the measurement of the tensile strength varies by less than 10%, regardless of whether the measurement is made in the longitudinal or transverse direction. The elastic recovery of this web defined according to standard ASTM D 1170 62 T is between 40 and 60% (standard F 36).

If, for certain applications, it is desired to obtain a less precise constant figure for the mass per unit of surface, it is possible to dispense with the peak removal process 15.

Of course it may also be possible to modify the conditions of supply of particulate materials at the top of the cowl; the material could for instance be weighed and conveyed to the top of the cowl by a conveyor belt, or by another means of transport.

In addition it is possible by virtue of the invention to manufacture stratified webs by aligning several successive cowls along the conveyor belt in order to superimpose a plurality of layers of different kinds. In this case a peak removal device should preferably be provided down stream of each cowl.

What I claim is:

1. A process for the dry production of non-woven uniform webs from particulate materials wherein particles are fed simultaneously over a substantial length of a conveyor belt, and at a superficial volume flow rate of less than 2,000 cm$^3$/m$^2$/min, subjecting the particles, upstream and downstream of the feed zone, to an upwardly directed return air flow above the belt and withdrawing the return air flow above the point of introduction, which assists in the distribution of the supply of particles over the whole length of the feed zone, and carrying out the feeding in a current of air which moves at low speed with local zones of turbulence imparting to the particles a vertical speed component substantially lower than the speed of free fall, the particles being arranged randomly on the conveyor belt in the form of an uncompacted homogeneous and isotropic aerated layer having a percentage of empty space greater than 95%, and, at subsequent downstream points, levelling, predensifying, and, optionally, calendering the layer.

2. A process according to claim 1, wherein the particles are fed onto the belt at a superficial volume flow rate of between 1,000 cm$^3$/m$^2$/min and 100 cm$^3$/m$^2$/min.

3. A process according to claim 1, wherein the layer of particles is deposited with a percentage of empty space between 98% and 99.5%.

4. A process according to claim 1 wherein, the conveyor belt is permeable with the predensifying being effected by means of a reduced pressure exerted below the permeable conveyor belt, the effect of the said pressure reduction urging the particles vertically against the belt and compressing them homogeneously over the whole area of the belt.

5. A process according to claim 3, wherein after feeding and predensifying, the layer of particles is precalendered by compression under a cylinder to bring the web to an apparent specific mass corresponding to a percentage of empty space between 75% and 85%.

6. A process according to claim 5, wherein, in conjunction with the precalendering step, a pressure reduction is exerted on the layer from underneath the conveyor belt.

7. A process according to claim 1, wherein after the deposit of the particles on the belt and before predensifying, the levelling of the layer of particles is effected by peak removal and the removal of the surplus of materials, at the same time avoiding any compacting of the layer of particles.

8. A process according to claim 7, wherein the peak removal in a plane perpendiculr to the axis of translation of the layer of particles is at an inclination to the horizontal whereby a finished web is obtained of which the mass per unit of surface continuously varies transversely to the axis of said web.

9. A non-woven web produced in accordance with the process of claim 1.

* * * * *